United States Patent [19]

Johansson

[11] 4,123,480

[45] Oct. 31, 1978

[54] THROTTLE CONTROL MECHANISM FOR A CARBURETOR

[75] Inventor: Rolf A. G. Johansson, Unnaryd, Sweden

[73] Assignee: Jonsereds AB, Partille, Sweden

[21] Appl. No.: 768,378

[22] Filed: Feb. 14, 1977

[30] Foreign Application Priority Data

Feb. 16, 1976 [SE] Sweden ..... 76 016799

[51] Int. Cl.[2] ..... F02M 1/02

[52] U.S. Cl. ..... 261/52

[58] Field of Search ..... 261/52

[56] References Cited

U.S. PATENT DOCUMENTS

| | | | |
|---|---|---|---|
| 1,338,960 | 5/1920 | Povlotzky | 261/52 |
| 1,456,502 | 5/1923 | Hartwell | 261/52 |
| 2,198,676 | 4/1940 | Mallory | 261/52 |
| 2,478,613 | 8/1949 | Weber | 261/52 |
| 2,815,942 | 12/1957 | Olson | 261/52 |
| 2,873,731 | 2/1959 | Richardson | 261/52 |
| 3,305,223 | 2/1967 | Reichenbach | 261/52 |
| 3,907,945 | 9/1975 | Kobayashi et al. | 261/52 |

FOREIGN PATENT DOCUMENTS

| | | | |
|---|---|---|---|
| 577,186 | 5/1933 | Fed. Rep. of Germany | 261/52 |

*Primary Examiner*—Tim R. Miles

*Attorney, Agent, or Firm*—Holman & Stern

[57] ABSTRACT

A control mechanism for a carburetor having a throttle valve and a choke valve each of which valves has an idling position, a cold-starting position and a full-speed position. The throttle valve is spring-biased towards its idling position and the choke valve is spring-biased towards it full-speed position. Control levers are associated with the respective valves whereby when the choke valve is moved from its idling position towards it full-speed position, a lever member associated with the choke valve engages another lever member associated with the throttle valve and the interengaging lever members hold both valves in their cold-starting position in opposition to the biasing springs. From the cold-starting condition the lever members can be released by operation of the throttle valve causing the choke valve to be returned to its open position by its biasing spring or alternatively the choke valve can be moved independently to its full-speed position by a further control lever while the lever members remain in engagement.

6 Claims, 4 Drawing Figures

THROTTLE CONTROL MECHANISM FOR A CARBURETOR

BACKGROUND OF THE INVENTION

The present invention relates to a throttle control for a carburetor or the like fuel/air mixing apparatus, intended particularly for a power saw and provided with a throttle valve device and a choke valve, in which the choke valve is adjustable between a normal idling position and a cold starting position.

In several carburetor applications it is necessary that the throttle valve is arranged automatically to return to its idle position. In several of these cases, for example where the motor is started by hand, it is necessary that the throttle valve device is provided with a retaining member, which makes it possible to retain the valve in a position appropriate for starting. In order not to take away the effect of an automatically returning throttle control it is necessary also that the retaining member is arranged to return automatically. This has usually been arranged in that the motor has been provided with a particular control adjacent the throttle by means of which the retaining member is operated. The handles of power saws with control means have in recent years often been made vibration-free relative to the motor and the implement driven thereby. The throttle control has become movably suspended in relation to the motor which has raised difficulties in obtaining a well defined starting position for the throttle control. On the market there are examples of machines where different specimens of the same model have different motor speeds in the magnitude of 100 rps with no motor load and with the throttle control arrested in starting position. This condition is highly unsatisfactory on one hand as the motor will race to speeds which can be detrimental, particularly to a cold motor and on the other hand as the high speed can cause accidents. A choke device must usually be used when cold starting a motor. Motors equipped with throttles as mentioned above thus have three different controls, which must be operated, i.e. a throttle control, a retaining member and a cold choke control. The choke control must be returned manually as soon as the motor ignites and it is often necessary thereupon to restart the motor.

The choke must in order to avoid motor failure be arranged in such a manner that during running it cannot return to the cold starting position e.g. upon influence from vibrations caused by the motor. Motors are oftenly provided with means adapted to prevent such return.

SUMMARY OF THE INVENTION

Thus there is a need for accurate setting of the throttle before starting and of reducing the necessary number of controls, handles and starting attempts required with a cold motor. The purpose of the present invention is to provide a throttle control simultaneously solving these problems and to simplify the type of adjustment devices hitherto used. This is achieved by the invention with a throttle control for a carburetor, intended, particularly for a power saw and provided with a throttle valve and a choke valve, in which the choke valve is adjustable between a normal rest position and a cold starting position, characterized therein, that the throttle valve and the choke are provided with a first and a second retaining members arranged to cooperate to retain the choke valve in its starting position upon adjustment thereof to such position and that the choke valve is provided with a return member adapted for resetting the choke to its rest position when the throttle valve is then operated.

DESCRIPTION OF THE PREFERRED EMBODIMENTS

Figure 1:
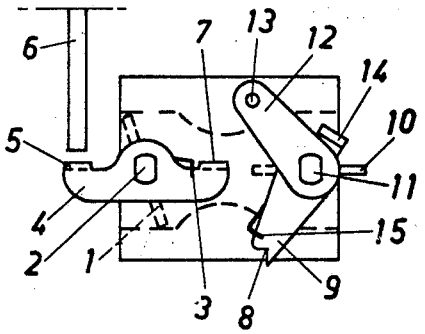
FIG. 1 shows in a schematic side elevation a carburetor with an adjustment mechanism.
Figure 2:
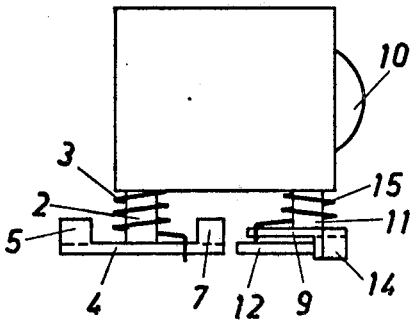
FIG. 2 shows the carburetor seen from above.

The carburetor comprises a throttle valve 1, which is rotatably mounted on a shaft 2 in the gas channel (shown with dash lines in FIG. 1). A torsion spring 3 is arranged around the shaft 2 and it is fixed to the carburetor in such a manner that, via a first double lever 4 and the shaft 2 which are nonrotatably connected to each other, the spring 3 biases the valve 1 in clock-wise, throttling direction in the gas channel. The first double lever 4 is on each side of the shaft 2 provided with projections 5, 7. A first one of these projections 5 cooperates with a push rod 6 (shown in FIG. 1 only) in such a manner that the valve 1 will open or close the gas channel in response to the reciprocating movement of the push rod 6. The push rod 6 is connected to a hand control (not shown) in such a manner that it is given its reciprocating motion when the hand control is operated manually. The second projection 7 cooperates with a recess 8 in a second lever 9 associated with a choke valve 10 located in the gas channel. The valve 10 is rotatable about a shaft 11 between open and closed positions in the gas channel. Said shaft 11 supports a control lever 12 which is unrotatably mounted on said shaft. The control lever 12 has a bore 13, which (not shown) is connected to a hand control in such a manner that the valve 10 can be manually adjusted between its two terminal positions. The second lever 9 is rotatable on the shaft 11 but it is provided with a stop 14 intended to cooperate with the control lever 12 and its movement in relation to the shaft 11 is therefore limited in such a manner that it, when rotating in counter-clockwise direction, will turn the shaft 11 until the valve 10 is brought to its open position in the gas channel.

Figure 3:
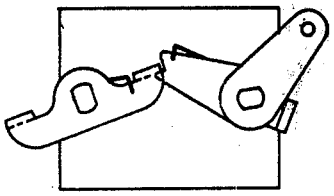
FIGS. 3 and 4 are side elevations showing the carburetor with the adjustment mechanism in different working positions.

The shaft 11 is provided with a torsion spring 15 which is mounted on the shaft and has one of its ends fixed to the carburetor. The other end of said spring cooperates with the second lever 9, biasing this in counter-clockwise direction, i.e. the shutter 10 is brought to its open position. The mechanism operates in the following mode:

Rotation of the control lever 12 in clockwise direction will also cause the shaft 11, which is firmly connected to said lever to pivot and the valve 10, which is fitted to the shaft 11 will be pivoted in the same direction and the second lever 9 due to cooperation between the stop 14 and the control lever 12 will also be pivoted. The torsion spring 15 is hereby stretched due to its engagement with the second lever 9. The second lever 9 will during its movement engage the projection 7 of the first double lever 4 and will thereupon against the biasing force of the torsion spring 3 pivot the valve 1 in a direction to open the gas channel. At the same time the valve 10 will reach its closing position when the projection 7 is in engagement with the recess 8 of the second lever. This interengaged setting of the carburetor levers is shown in FIG. 3. The lever 4 is prevented by lever 9 from being rotated in clockwise direction by the influence of spring 3. The lever 9 is also prevented by lever 4 from being turned in the anticlock-wise direction by the influence of spring 15. The setting according to FIG. 3 is thus retained as long as the operator does not manually actuate the carburetor via the push rod 6 or via the bore 13 in lever 12. This is the cold starting position of the mechanism in which the choke valve 10 is closed, whereas the throttle valve 1 is partly opened. Resetting the adjustment devices can be arranged in two different ways. One way is to operate the hand control for bringing the push rod 6 to open the valve 1 further via the intermediary of the projection 5. The projection 7 will hereby escape from the recess 8, which means that the second lever 9 will be pivoted in counter-clockwise direction by means of the torsion spring 15 and the stop 14 on the second lever 9 will engage the control lever 12 causing the valve 10 to be opened. The hand control (not shown) and which is connected to the bore 13 follows the movements of lever 12. As soon as the push rod 6 releases the i.e. 5 the valve 1 will throttle the gas channel, i.e., the control mechanism will take up the idling position shown in FIG. 1. The other way to reset the carburetor from the position shown in FIG. 3 is to open the valve 10 by pivoting the control lever 12 together with said hand control to the position shown in FIG. 4, which position is a warm starting position or a fast idling position. In this position choke valve 10 is entirely open, whereas the throttle is only partially open. The mode of operation is after that equal to that of the alternative mode of operation first described besides the fact that the shutter 10 in this alternative does not have to be opened by the spring 15.

In order to elucidate the simple, reliable adjustment mechanism according to the invention and the simplified handling of a carburetor provided with such an adjustment mechanism hereinafter two power saws are compared, one being equipped with the control mechanism according to the invention and the other one having a conventional control mechanism.

A power saw equipped according to the invention needs only the cold starting control be operated in order to make the power saw ready for a cold start (FIG. 3). In order to achieve this at a conventionally equipped power saw is it necessary to operate the cold starting control, a first retaining member preventing unintended opening of the throttle, a gas flow adjustment control and a second retaining member for this, i.e. it is necessary to operate four different controls, which should be compared to the operation of only one control in a power saw equipped with a throttle control according to the invention. When the motor ignites the cold starting control of the conventionally equipped power saw must swiftly be reset and thereupon it is necessary to operate the gas flow adjustment control. It is generally not possible to make these two operations sufficiently fast to ensure that the motor shall keep running, but it is instead often necessary to make new starting attempt, whereby the cold starting device is not used. When a motor equipped in accordance with the invention ignites is it only necessary to operate the throttle valve control as the choke valve is automatically reset. Thanks to the time saved thereby, the risk that the motor shall stall is almost completely eliminated, i.e. an extra starting attempt can be avoided.

Figure 4:
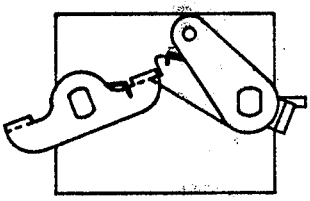

When starting a hot motor it is often necessary to increase the throttle opening beyond the idling position. This is, in a conventionally equipped power saw accomplished by having the throttle valve control arrested in a position as described in the cold starting method hereabove, whereby three controls must be operated. In a power saw with a control mechanism according to the invention it is however necessary to close the cold starting control only and thereupon to open it again to allow the valves to be arrested in a position allowing partial gas flow (FIG. 4). The arresting or retaining members of the two constructions will both return as soon as the throttle valve control is operated.

The handles of the power saws of today are made vibration-free in relation to the motor. As the throttle valve control with the retaining member hereby will be movably hinged in relation to the motor will difficulties arise to maintain a well defined starting position for the throttle valve at a conventional saw. This means besides a negative influence on the motor starting conditions a risk for accidents if the motor with the implement driven thereby will race to a high speed directly at start as the operator then will not have full control over the power saw. When using a control system in accordance with the invention is achieved an accurate adjustment of the throttle valve, which means that the above mentioned drawbacks are avoided.

The choke control of the conventional power saw must be made comparatively small and difficult to get at in order to prevent that twigs too often shall cause the motor to stop by actuating the control. For the same reason and in order to prevent vibrations from the motor influencing the cold starting device is the carburetor usually provided with a device which retains the choke in running position. A power saw with a control system according to the invention can without drawbacks be provided with a cold starting control, which is easily attainable also for a gloved hand as the cold starting device is returning automatically after it is eventually actuated by a twig. The automatic return motion makes it unnecessary to make other specific arrangements for arresting the cold starting device.

A power saw with a control system in accordance with the invention is structually easier and cheaper to manufacture than the power saw having a conventional control system. This depends thereupon that two simple parts according to the invention, viz. the second lever 9 and the torsion spring 15 eliminate the separate arresting member of the gas control, the control member for this arresting member and furthermore a separate device, which should prevent the cold starting control from taking up the cold starting position during normal running. The control mechanism according to the invention is not limited to the embodiment shown in the drawing and described in connection thereto but can be modified and altered in several different ways within the scope of the claims. It is thus possible to further simplify the design partly on account of other advantages by designing the second lever 9 integrally with the control lever 12. It is also possible to arrange the mechanism in such a way that it can arrest the throttle valve and the choke valve in several different combinations of positions by designing the second lever 9 and/or the first double lever 4 with several recesses 8 and projections 7, repsectively. The invention can be utilized for carburetors having other types of throttle devices and choke devices or in other types of fuel air mixing systems, differing from the carburetor. It is furthermore not necessary that the control mechanism according to the invention is fitted in direct connection to a carburetor or a similar member but it can for instance be located at a operating control spaced from the motor.

What I claim is:

1. A control mechanism for a fuel/air mixing apparatus having a throttle valve and a choke valve, said valves each having an idling position, a cold starting position and a full speed position, said control mechanism including first biasing means biasing said throttle valve toward its idling position, second biasing means biasing said choke valve toward its full speed position, interengageable means associated with the respective valves for holding both valves in their cold starting positions in opposition to the biasing means upon movement of said choke valve from its idling position toward its full speed position and further means associated with the throttle valve for releasing said interengageable means by movement of the throttle valve from its cold starting position toward its full speed position.

2. The control mechanism of claim 1 wherein said interengageable means comprises a first lever member associated with said choke valve and a second lever member associated with said throttle valve, said first lever member having a formation for engaging a complementary formation on said second lever member when said choke valve is moved from its idling position toward its full speed position and thereby holding said lever members in interengagement in opposition to the respective biasing means.

3. The control mechanism of claim 2 wherein said further means includes a third lever member associated with said throttle valve and means for acting on said third lever member in opposition to said first biasing means for moving said throttle valve toward its full speed position.

4. The control mechanism of claim 1, further including means for moving said choke valve between its cold starting position and its idling position during interengagement of said interengageable means.

5. The control mechanism of claim 2 wherein said choke valve is mounted on a choke valve shaft, said first lever member is rotatable about said shaft and wherein said mechanism further includes a lever non-rotatably mounted on said shaft, said first lever member and said lever having cooperating abutment means allowing said first lever member to move in unison with said lever when pressure is applied to said lever in one direction for moving said choke valve from its idling position into its cold starting position and bringing said first and second lever members into interengagement, said lever being movable independently of said first lever member when said first lever member and said second lever member are interengaged to move said choke valve between its cold starting and full speed positions and said abutment means effecting movement of said lever member and said lever in unison on release of said interengageable means to move said choke valve from its cold starting position to its idling position.

6. The control mechanism of claim 5 wherein said second biasing means comprises a coil spring means surrounding said shaft and acting on said first lever member.

* * * * *